US011382476B2

(12) United States Patent
Ruffo

(10) Patent No.: US 11,382,476 B2
(45) Date of Patent: Jul. 12, 2022

(54) ORBITAL SINGLE-BRUSH MACHINE FOR TREATING FLOORS

(71) Applicant: T.M.B. S.R.L., San Giovanni Lupatoto (IT)

(72) Inventor: Giampaolo Ruffo, Verona (IT)

(73) Assignee: T.M.B. S.R.L., San Giovanni Lupatoto (IT)

( * ) Notice: Subject to any disclaimer, the term of this patent is extended or adjusted under 35 U.S.C. 154(b) by 0 days.

(21) Appl. No.: 17/048,810

(22) PCT Filed: Apr. 3, 2019

(86) PCT No.: PCT/EP2019/058385
§ 371 (c)(1),
(2) Date: Oct. 19, 2020

(87) PCT Pub. No.: WO2019/201602
PCT Pub. Date: Oct. 24, 2019

(65) Prior Publication Data

US 2021/0113046 A1 Apr. 22, 2021

(30) Foreign Application Priority Data

Apr. 19, 2018 (IT) ..... 102018000004693

(51) Int. Cl.
*A47L 11/162* (2006.01)
*A47L 11/40* (2006.01)
*A47L 11/12* (2006.01)

(52) U.S. Cl.
CPC ..... *A47L 11/12* (2013.01); *A47L 11/162* (2013.01); *A47L 11/4038* (2013.01);
(Continued)

(58) Field of Classification Search
CPC ..... A47L 11/162; A47L 11/164; A47L 11/03; A47L 11/283; A47L 11/4038
See application file for complete search history.

(56) References Cited

U.S. PATENT DOCUMENTS 3,055,030 A * 9/1962 Ardito ..... A47L 11/164 15/49.1
2006/0150362 A1 7/2006 Mitchell
(Continued)

OTHER PUBLICATIONS

International Search Report and Written Opinion dated May 21, 2019 issued in PCT/EP2019/058385.
(Continued)

*Primary Examiner* — Randall E Chin
(74) *Attorney, Agent, or Firm* — Scully, Scott, Murphy & Presser, P.C.

(57) ABSTRACT

An orbital single-brush machine that comprises a chassis which is configured to rest on the floor and is provided with at least one movement handle. The chassis is connected to a motor which is adapted to actuate with combined rotary and orbital motion a work tool that acts on the floor; the chassis comprises a first footing, which is at least partially substantially plate-shaped and is spaced apart from the floor, and a second footing, which is at least partially substantially plate-shaped, supports the motor and is arranged below the first footing, and is supported so that it can rotate freely by the first footing about an oscillation axis which is substantially parallel to the floor and substantially perpendicular to the direction of advancement of the machine. Shock absorbing means are provided which act between at least one portion of the first footing and at least one portion of the second footing.

7 Claims, 5 Drawing Sheets

(52) U.S. Cl.
CPC ..... *A47L 11/4052* (2013.01); *A47L 11/4069* (2013.01); *A47L 11/4072* (2013.01)

(56) References Cited

U.S. PATENT DOCUMENTS

| | | | | |
|---|---|---|---|---|
| 2012/0118319 | A1* | 5/2012 | Stuchlik ..... | A47L 11/293 134/6 |
| 2013/0243526 | A1 | 9/2013 | Williamson et al. | |
| 2016/0296093 | A1 | 10/2016 | Legatt et al. | |

OTHER PUBLICATIONS

Italian Search Report and Written Opinion dated Sep. 11, 2018 issued in IT 201800004693, with partial translation.

* cited by examiner

ORBITAL SINGLE-BRUSH MACHINE FOR TREATING FLOORS

The present invention relates to an orbital single-brush machine for treating floors.

Single-brush machines are known for treating floors, which are constituted by a chassis base, fitted with wheels, to which a movement handle is connected at the rear. The chassis base supports a brush below it, which acts on the floor and which is actuated in rotation by a motor fitted on the base.

In particular, orbital single-brush machines are known on the market, in which the brush is actuated with a combined rotary and orbital motion which is transferred from the motor to the brush by way of a cam screw mechanism.

In traditional orbital single-brush machines, the base is constituted by a pair of lateral supporting arms that extend parallel to the advancement direction of the machine and which, at their rear end, have wheels resting on the floor and, at their front end, oscillatingly support the motor and the kinematic mechanism that make it possible to actuate the brush with a combined rotary and orbital motion.

This structural organization of orbital single-brush machines renders such machines quite cumbersome and heavy, with the consequence that they are almost exclusively used in industrial or professional contexts and they are not easily transported.

Furthermore, orbital single-brush machines tend to transmit vibrations to the user.

The aim of the present invention is to provide an orbital single-brush machine for treating floors that is capable of improving the known art in one or more of the above mentioned aspects.

Within this aim, an object of the invention is to provide an orbital single-brush machine that, owing to its peculiar characteristics of construction, has reduced dimensions and weight or at least dimensions and weight that are similar to those of a traditional single-brush machine, and which at the same time can be easily maneuvered for any operator and is highly versatile.

Another object of the invention is to provide an orbital single-brush machine that in terms of construction is simple to provide so that it can be easily used in various different application contexts.

Another object of the invention is to provide an orbital single-brush machine that, as needed, can also be equipped with machining tools other than the normal brush that is typically used, without any degradation in the performance of the machine.

Another object of the present invention is to provide an orbital single-brush machine that is capable of offering the maximum assurances of safety in its operation, preventing, or in any case considerably limiting, the possibility that vibrations or hazardous or harmful forces could be transmitted to the user.

Another object of the invention is to provide an orbital single-brush machine that is highly reliable and which is competitive from an economic viewpoint as well.

This aim and these and other objects which will become better apparent hereinafter are achieved by an orbital single-brush machine according to claim 1, optionally provided with one or more of the characteristics of the dependent claims.

Further characteristics and advantages of the invention will become better apparent from the description of a preferred, but not exclusive, embodiment of the orbital single-brush machine according to the invention, which is illustrated by way of non-limiting example in the accompanying drawings wherein.

Figure 1:
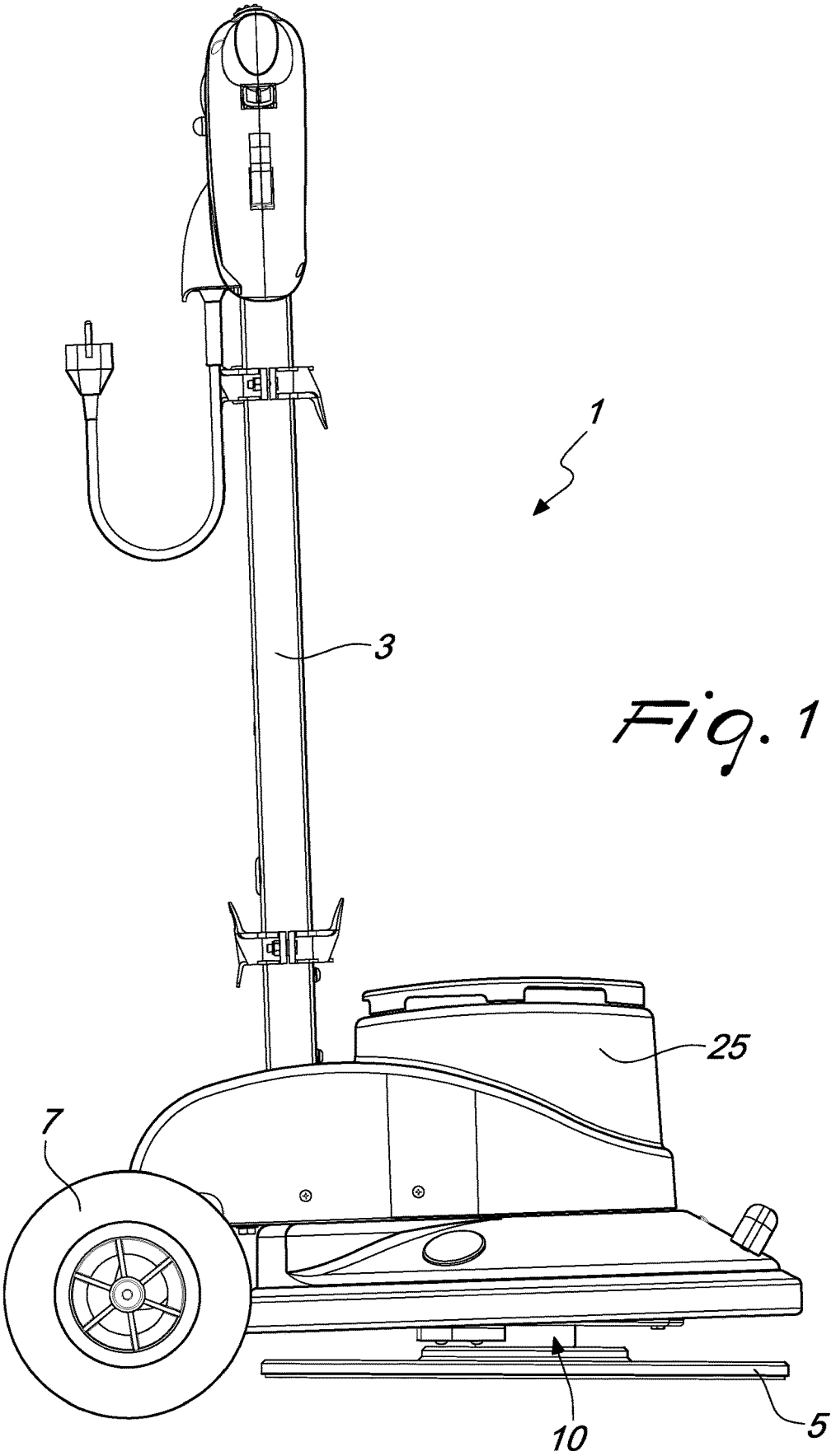
FIG. 1 is a side view of the machine according to the invention.
Figure 2:
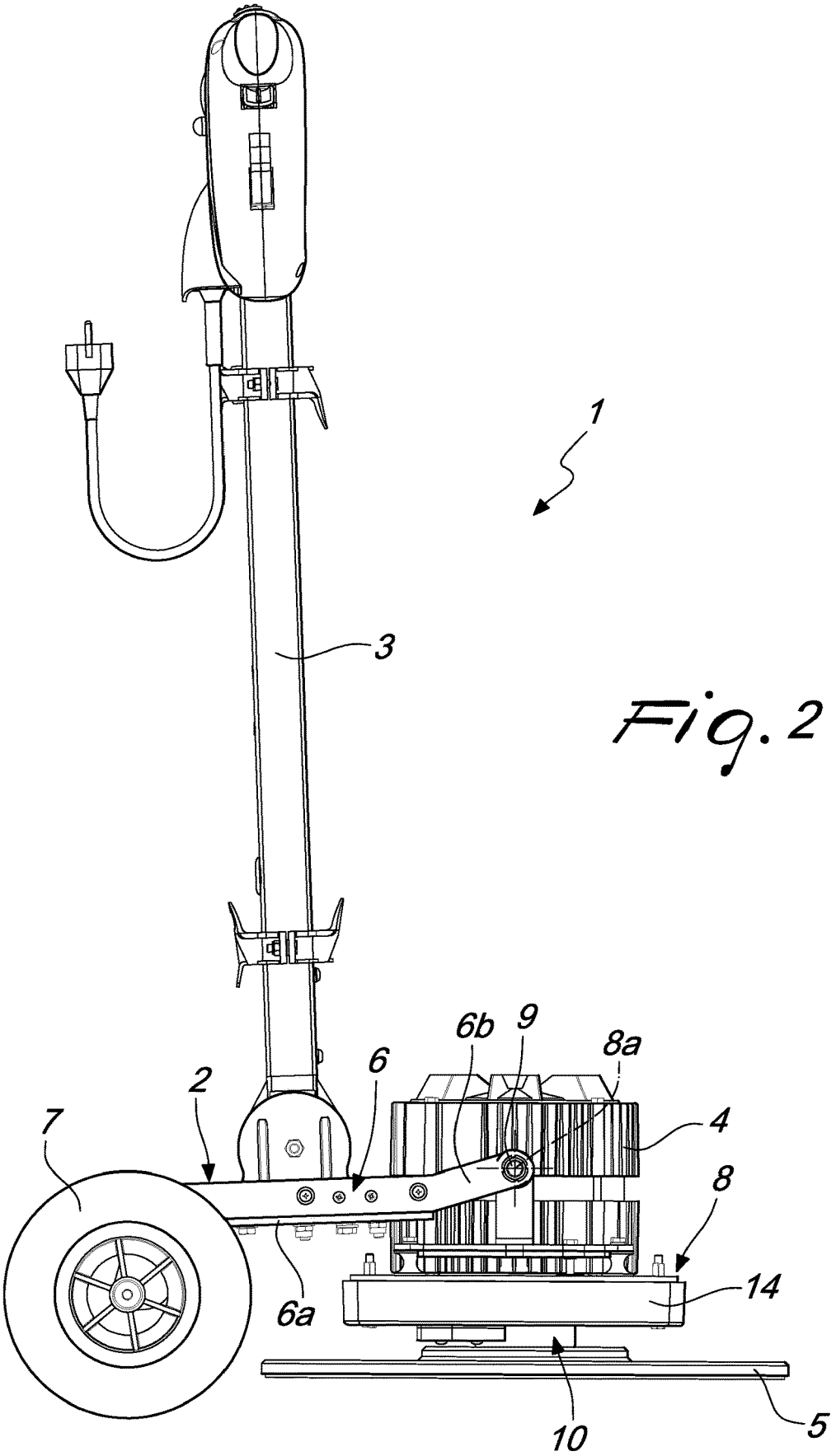
FIG. 2 is a side view of the machine according to the invention, with an outer containment housing omitted.
Figure 3:
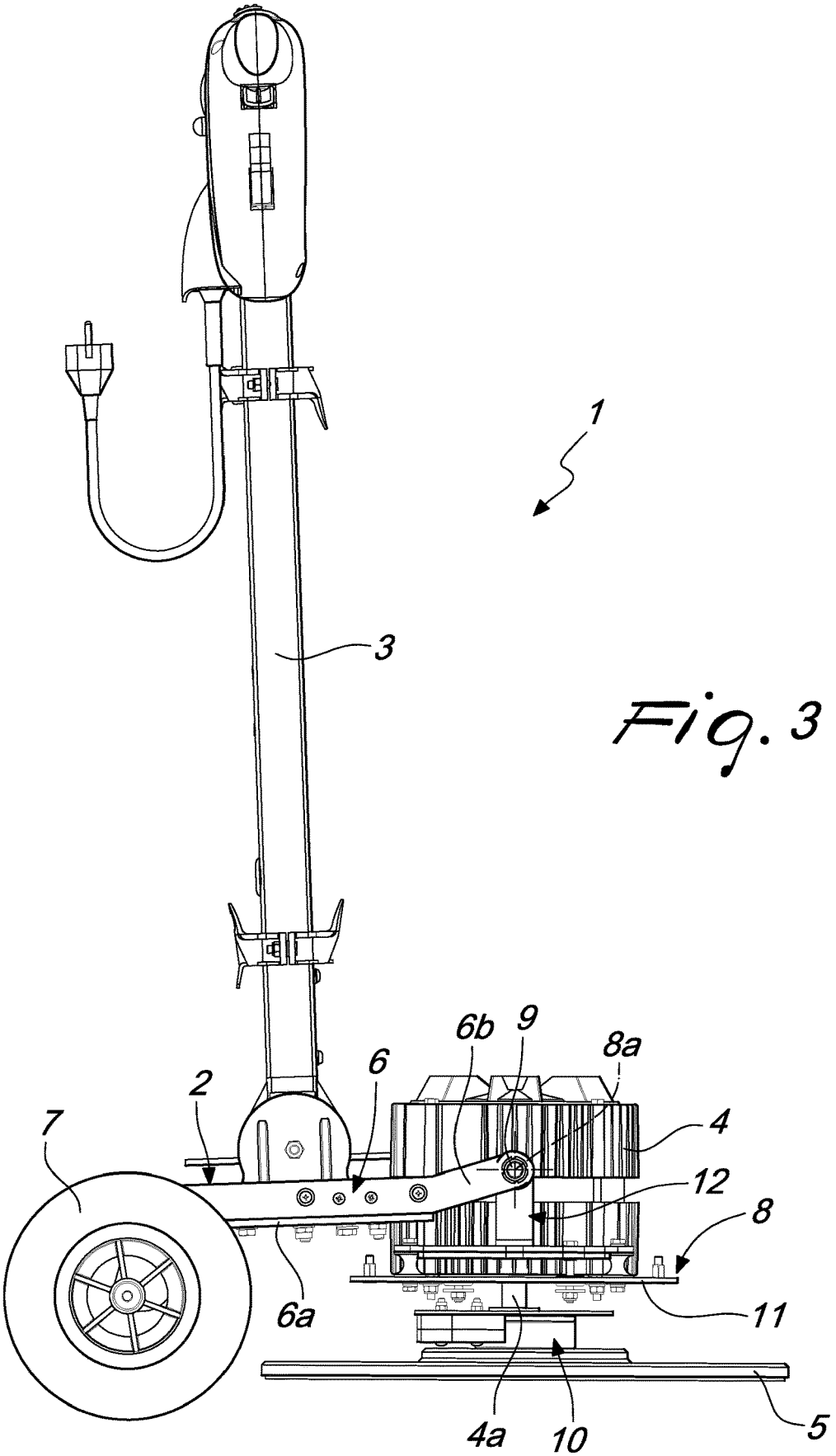
FIG. 3 is a side view of the machine according to the invention, in which, in addition to the outer containment housing, an inertial mass is omitted.
Figure 4:
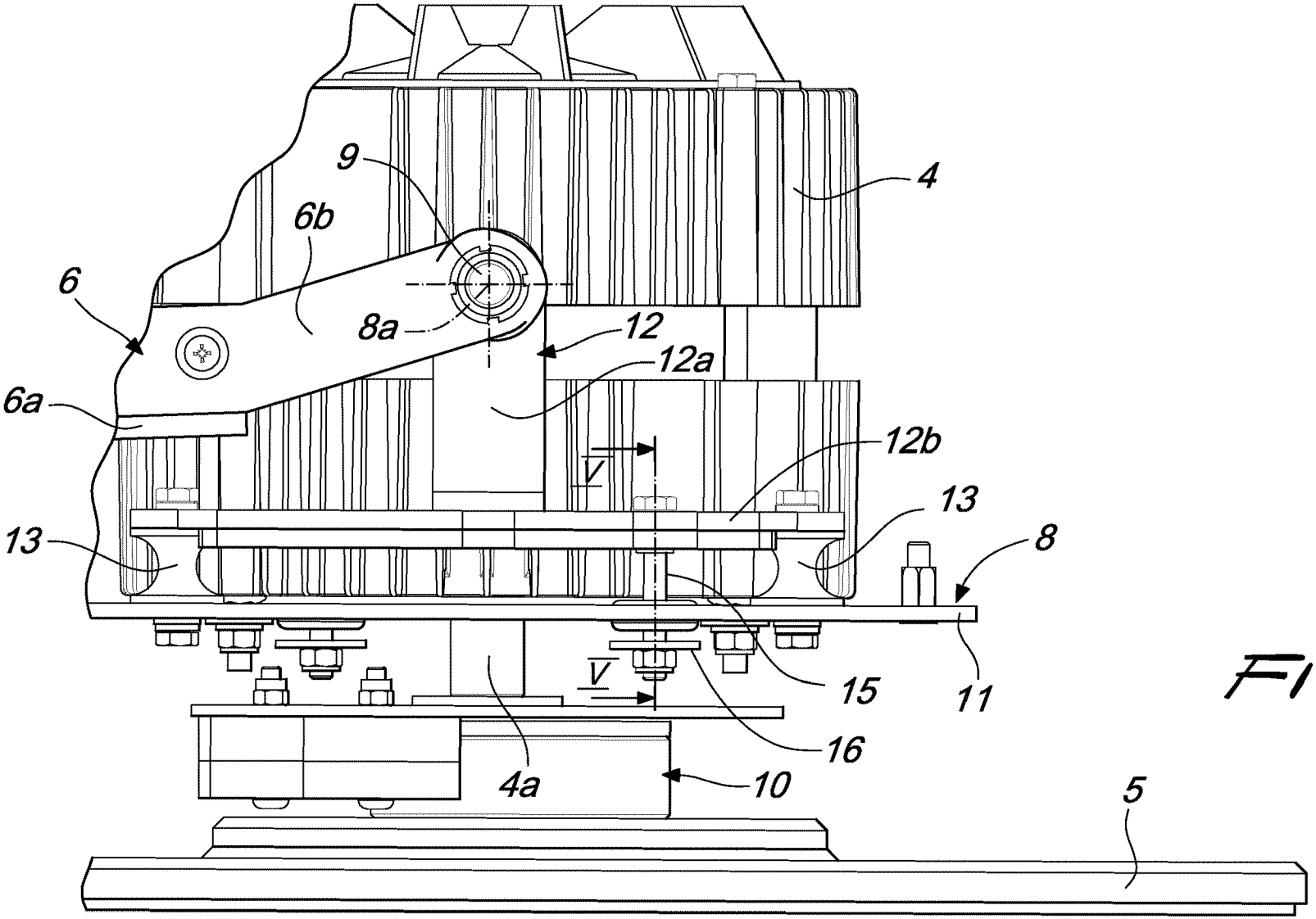
FIG. 4 is an enlarged-scale view of a detail of FIG. 3.

With reference to the figures, the orbital single-brush machine according to the invention, generally designated by the reference numeral 1, comprises a chassis 2 which rests on the floor and is provided with at least one movement handle 3 in order to allow the chassis 2 to be moved on the floor by an operator.

The chassis 2 is connected to a motor 4 which makes it possible to actuate, with combined rotary and orbital motion, a work tool 5 that acts on the floor, which can be constituted, for example, by a normal brush or, alternatively, also by a polishing pad or the like, according to the treatment to be carried out.

According to the invention, the chassis 2 comprises a substantially plate-shaped first footing 6, which is, advantageously, spaced apart from the floor and is provided at the rear, with respect to the advancement direction of the machine, with at least one pair of wheels 7 resting on the floor, which are mutually opposite.

Conveniently, the movement handle 3 is hinged in a lower region to the first footing 6.

The chassis 2 further comprises a substantially plate-shaped second footing 8, which supports the motor 4 and is arranged below the first footing 6 and is supported so that it can rotate freely by the first footing 6 about an oscillation axis 8*a* that is substantially parallel to the floor and substantially perpendicular to the advancement direction of the machine.

In particular, the second footing 8 is freely pivoted to the first footing 6 about the oscillation axis 8*a* by way of a pair of hinges 9 which are mutually opposite with respect to the motor 4.

Advantageously, shock absorbing means act between at least one portion of the first footing 6 and at least one portion of the second footing 8, and make it possible to attenuate the vibrations that otherwise would be transmitted to the first footing 6 and therefore to the handle 3 from the work tool 5, through the second footing 8.

Conveniently, on its side directed toward the floor, the second footing 8 supports means for kinematic connection 10, conventional, connecting the motor 4 with the work tool 5, which are adapted to give the work tool 5 a combined rotary and orbital motion, for example by way of an eccentric transmission.

As in the embodiment illustrated, the first footing 6 can have a plate-shaped portion 6*a* from which a pair of lateral supporting arms 6*b* protrudes forward with respect to the direction of advancement of the machine, to which and, in particular, to the free end of which, the second footing 8 is connected.

More specifically, the lateral supporting arms 6*b* can have a first portion, which extends starting from the plate-shaped portion 6*a* with an extension substantially horizontal or parallel to the floor and an inclined second portion, connected to the first portion, which extends upwards, proceeding toward the front end of the machine, to which the second footing 8 is pivoted by way of the hinges 9.

It should be noted that the handle 3, in such embodiment, can be conveniently connected to the plate-shaped portion 6*a*, in a position interposed between the supporting wheels 7 and the lateral supporting arms 6*b* of the second footing 8.

Again with reference to the embodiment shown, the second footing 8 comprises a lower plate 11, to which the motor 4 is fixed, preferably by way of bolts, and which is arranged on a plane that is substantially perpendicular to the axis of the shaft 4*a* of the motor 4.

The lower plate 11 is connected to at least one upper structure 12, which is pivoted to the first footing 6 about the oscillation axis 8*a*. More specifically, there is a pair of upper structures 12 which are arranged laterally to the motor 4, on mutually opposite sides, with respect to a central plane of symmetry of the machine which is substantially perpendicular to the floor and which is substantially parallel to the advancement direction of the machine.

The connection between the lower plate 11 and each upper structure 12 is such as to allow a possibility of relative movement between the lower plate 11 and the upper structures 12 at least along a direction of motion that is substantially parallel to the axis of the shaft 4*a* of the motor 4.

In particular, the lower plate 11 is slideable and guided in its movement relative to the upper structures 12 by at least one pair of guide rods 15, mutually opposite with respect to the motor 4, which extend downward from the upper structures 12 and substantially parallel with the axis of the shaft 4*a* of the motor 4, passing through with play respective openings 11*a* which are defined at the peripheral region of the lower plate 11 and are advantageously lined, on their perimetric edge, by a grommet 20, made of elastically yielding material, such as rubber or the like.

Conveniently, the above mentioned shock absorbing means comprise a plurality of vibration damping elements 13 which are interposed between the lower plate 11 and the upper structures 12. In particular, the vibration damping elements 13 are distributed along the peripheral region of the lower plate 11 so as to be arranged around the motor 4 and are each constituted by a substantially cylindrical body, optionally grooved i.e. provided with a circumferential hollow on its lateral surface, arranged, with its axis, substantially parallel to the direction of motion of the lower plate 11 with respect to the upper structures 12 and made of an elastically yielding material, preferably with a hardness substantially equal to 45 Shore.

Conveniently, each one of the upper structures 12 comprises an oscillation arm 12*a*, which is hinged by way of a corresponding hinge 9 to the first footing 6 and, more precisely, to a corresponding lateral supporting arm 6b and which extends upward from a respective base element 12*b*, which is preferably C-shaped or shaped like a circular arc, so as to extend around the motor 4, and is constituted, for example, by a flat bar, which faces the lower plate 11 and acts as an abutment for the vibration damping elements 13.

Figure 6:
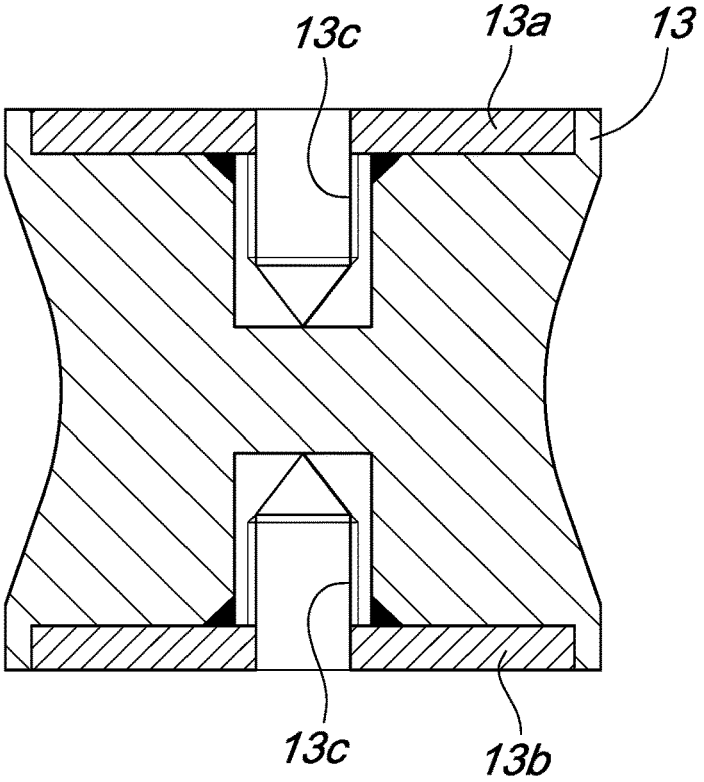
FIG. 6 is a longitudinal cross-sectional view of a vibration damping element.

In more detail, as shown in FIG. 6, each vibration damping element 13 has, at its ends, two abutment plates 13*a* and 13*b*, which are arranged at right angles to the axis of the vibration damping element 13 and are made of a material with a greater rigidity than the cylindrical body of the vibration damping element 13, and which are passed through axially by a respective threaded hole 13*c* for the accommodation of fixing screws that make it possible to connect the ends of the vibration damping element 13 respectively to the lower plate 11 and to the base element 12*b*.

Advantageously, the lower plate 11 is fixed in a downward region to an inertial mass 14, which increases the weight of the lower plate 11, by exerting an action thereupon that tends to keep them spaced apart downward from the upper structures 12, in order to ensure, under any condition, an optimal action of contact of the work tool 5 with the floor.

Advantageously, there are means for limiting the stroke that the lower plate 11 can travel with respect to the upper structures 12 along the direction of motion substantially parallel to the axis of the shaft 4*a* of the motor 4, in particular in the direction that causes the lengthening of the vibration damping elements 13.

In particular, such means for limiting the stroke comprise, advantageously, at least one stop element 16, which is arranged spaced apart downward from the upper structures 12 and which is engageable in abutment by the face of the lower plate 11 which is directed toward the floor, so as to limit the downward stroke of the lower plate 11 with respect to the upper structures 12 and thus define the maximum elongation that the vibration damping elements 13 can undergo.

More preferably, there is at least one pair of stop elements 16, each one constituted by a washer 16*a*, advantageously made of rigid material, such as for example a technopolymer, placed around a respective guide rod 15.

Figure 5:
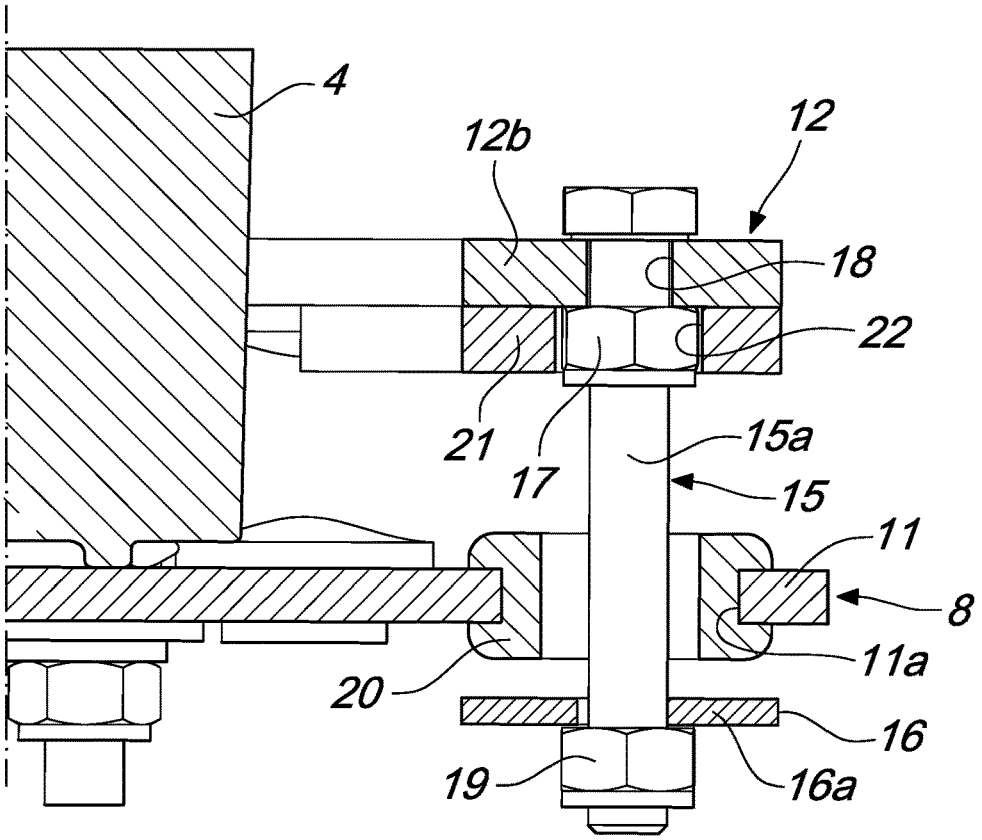
FIG. 5 is a cross-sectional view taken along the line V-V in FIG. 4.

As illustrated in particular in FIG. 5, the guide rods 15 can be, in particular, provided by respective screws 15*a*, which with their shank pass through corresponding through holes 18 defined in the base elements 12*b* of the upper structures 12 and which engage with their heads against the upper face of the base elements 12*b*, to which they are fixed by way of a lock nut 17, which is screwed along the screws 15*a* in order to engage the lower face of the base elements 12*b*, on the other side with respect to the heads of the screws 15*a*. Substantially at the end of the screws 15*a* opposite from their head, there is also a retaining nut 19 screwed on a respective washer 16*a*.

It should be noted that fixed below each base element 12*b* there is a reinforcement element 21, similarly contoured, which is passed through, at the through holes 18, by corresponding holes 22 in which the lock nuts 17 are accommodated.

Advantageously, the first footing 6 and the motor 4 are accommodated within a single outer containment housing 25, which extends, conveniently, to also cover at least partially the second footing 8, so as to confer adequate protection and compactness on the machine.

Operation of the machine according to the invention is as follows.

The operator, once the motor 4 is activated, can maneuver the machine by way of the handle 3 over the floor so as to carry out the desired floor treatment by way of the action of the work tool 5.

The motor 4, being supported by the second footing 8, which in turn is pivoted to the first footing 6, is free to rotate with respect to the first footing 6, thus enabling the work tool 5 to always remain completely in contact with the floor.

In this manner, the machine is capable of working correctly under any condition, i.e. with any type of floor and with any type of work tool 5.

Furthermore, during the cleaning operations, any forces that would be transmitted from the work tool 5 to the handle 3 are attenuated, if not eliminated, by virtue of the presence of the shock absorbing means which act between the first and the second footing 6 and 8.

In particular, the vibrations that come to be transmitted from the work tool 5 to the handle 3 are absorbed by the vibration damping elements 13 arranged between the lower plate 11 and the upper structures 12 of the second footing 8.

It should be noted that, during the operation of the machine, i.e. when the work tool 5 touches the floor, the lower plate 11 is spaced apart upward from the stop elements 16, such that the stop elements 16 do not work and the weight of the motor 4 and of the inertial mass 14 is transmitted to the ground.

When the operator has to lift the work tool 5 off the floor, the lower plate 11, by virtue of the weight of the motor 4 and of the inertial mass 14, tends to remain close to the ground, owing to its possibility to move with respect to the upper structures 12, with the risk that the vibration damping elements 13 could break owing to an excessive elongation under traction.

The means for limiting the stroke of the lower plate 11 and, more specifically, the stop elements 16 make it possible to prevent this risk, by limiting the lengthening stroke of the vibration damping elements 13, through the contact between the stop elements 16 and the grommets 20 mounted on the lower plate 11.

In practice it has been found that the invention fully achieves the intended aim and objects and in particular attention is drawn to the fact that the machine according to the invention, by virtue of the fact that it is structured with the first and the second footing, has a weight and space occupation that are comparable with those of a traditional non-orbital single-brush machine and are such as to make it easily usable even in a domestic context.

Furthermore, it must also be emphasized that, by virtue of the possibility of relative oscillation between the first and the second footing, and of the weight exerted by the inertial mass, independently of the type and height of the work tool used, i.e. a normal brush, a polishing pad or the like, the work tool is capable of always remaining in complete contact with the floor, which offers the machine according to the invention the capability to achieve a level of efficacy in the treatment carried out that is superior to any single-brush machine in the known art, with the additional advantage of being lighter and more compact as well as easy to maneuver on the floor, and without the need to apply a considerable force.

All the characteristics of the invention, indicated above as advantageous, convenient or similar, may also be missing or be substituted by equivalent characteristics.

The individual characteristics set out in reference to general teachings or to specific embodiments may all be present in other embodiments or may substitute characteristics in such embodiments.

The invention, thus conceived, is susceptible of numerous modifications and variations, all of which are within the scope of the appended claims. Moreover, all the details may be substituted by other, technically equivalent elements.

In practice, the materials used, as well as the contingent shapes and dimensions, may be any according to the requirements and to the state of the art.

The disclosures in Italian Patent Application No. 102018000004693 from which this application claims priority are incorporated herein by reference.

The invention claimed is:

1. An orbital single-brush machine, which comprises:

a chassis configured to rest on the floor and provided with at least one movement handle;

a motor being connected to said chassis and being adapted to actuate with a combined rotary and orbital motion a work tool which is adapted to act on the floor, wherein said chassis comprises a first footing, which is at least partially substantially plate-shaped and is configured to be spaced apart from the floor, and a second footing, which is at least partially substantially plate-shaped and is arranged below said first footing and is supported so that it can rotate freely by said first footing about an oscillation axis which is substantially parallel to the floor and substantially perpendicular to a direction of advancement of the machine, said second footing supporting said motor, shock absorbing means being provided which act between at least one portion of said first footing and at least one portion of said second footing, wherein said second footing comprises a lower fixing plate for said motor which is connected to at least one upper structure which is pivoted to said first footing about said oscillation axis, said lower plate being connected to said at least one upper structure with a possibility of relative movement at least along a direction of motion that is substantially parallel to the axis of the shaft of said motor, said shock absorbing means comprising a plurality of vibration damping elements which are interposed between said lower plate and said at least one upper structure; and means for limiting a stroke of said lower plate with respect to said at least one upper structure along said direction of motion, wherein said means for limiting the stroke comprise at least one stop element which is spaced downward from said at least one upper structure and can be engaged in abutment by said lower plate.

2. The machine according to claim 1, wherein said first footing is provided at the rear, with respect to the direction of advancement of the machine, with at least one pair of mutually opposite wheels for resting on the floor.

3. The machine according to claim 1, wherein said second footing is freely pivoted to said first footing about said oscillation axis by way of a pair of hinges which are mutually opposite with respect to said motor.

4. The machine according to claim 1, wherein said motor is fixed to a face of said second footing that is directed toward said first footing.

5. The machine according to claim 1, wherein said first footing has a plate-shaped portion from which a pair of lateral supporting arms of said second footing protrudes forward with respect to the direction of advancement of the machine.

6. The machine according to claim 1, wherein said second footing supports, on a side thereof configured to be directed toward the floor, means for kinematic connection between said motor and said work tool which are adapted to give said work tool said combined rotary and orbital motion.

7. The machine according to claim 1, wherein said vibration damping elements are distributed around said motor and each one comprises a substantially cylindrical body, made of elastically flexible material, which is arranged with its axis substantially parallel to said direction of motion.

* * * * *